US010612831B2

(12) United States Patent
Boarman et al.

(10) Patent No.: US 10,612,831 B2
(45) Date of Patent: Apr. 7, 2020

(54) REFRIGERATOR WITH ICEMAKER CHILLED BY THERMOELECTRIC DEVICE COOLED BY FRESH FOOD COMPARTMENT AIR

(71) Applicant: Whirlpool Corporation, Benton Harbor, MI (US)

(72) Inventors: Patrick Boarman, Evansville, IN (US); Brian K. Culley, Evansville, IN (US); Gregory Hortin, Henderson, KY (US); Mark Thomas, Corydon, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 130 days.

(21) Appl. No.: 15/642,542

(22) Filed: Jul. 6, 2017

(65) Prior Publication Data

US 2017/0307276 A1 Oct. 26, 2017

Related U.S. Application Data

(62) Division of application No. 13/691,919, filed on Dec. 3, 2012, now Pat. No. 9,714,784.

(51) Int. Cl.
*F25D 17/08* (2006.01)
*F25D 17/06* (2006.01)
*F25C 1/24* (2018.01)

(52) U.S. Cl.
CPC ..... *F25D 17/08* (2013.01); *F25C 1/24* (2013.01); *F25D 17/065* (2013.01)

(58) Field of Classification Search
CPC ..... F25C 1/24; F25D 17/08; F25D 17/065
See application file for complete search history.

(56) References Cited

U.S. PATENT DOCUMENTS 2,513,823 A 7/1950 Shreve
2,940,276 A * 6/1960 Loewenthal ..... F25C 1/12 62/138

(Continued)

FOREIGN PATENT DOCUMENTS

DE 102010001465 A1 8/2011
DE 102010042080 A1 4/2012

(Continued)

OTHER PUBLICATIONS

European Patent Office, "European Search Report," issued in connection with European Patent Application No. 13182465.8, dated Dec. 2, 2016, 9 pages.

(Continued)

*Primary Examiner* — David J Teitelbaum
(74) *Attorney, Agent, or Firm* — Nyemaster Goode, P.C.

(57) ABSTRACT

A refrigerator that has a fresh food compartment, a freezer compartment, and a door that provides access to the fresh food compartment is disclosed. An icemaker is mounted remotely from the freezer compartment. The icemaker includes an ice mold. A thermoelectric device is provided and includes a warm side and an opposite cold side. The icemaker is thermally influenced by the cold side of the thermoelectric device. Air or fluid may be moved from the fresh food compartment across the warm side of the thermoelectric device. Cold air or fluid, such as from the refrigerator compartment, is used to dissipate heat from the warm side of the thermoelectric device for cooling the ice mold of the icemaker.

13 Claims, 8 Drawing Sheets

(56) References Cited

U.S. PATENT DOCUMENTS

| | | | | |
|---|---|---|---|---|
| 3,073,126 | A | 1/1963 | Staebler | |
| 3,138,934 | A | 6/1964 | Roane | |
| 3,146,601 | A | 9/1964 | Gould | |
| 3,192,726 | A * | 7/1965 | Newton | F25B 21/04 62/3.63 |
| 3,237,415 | A | 3/1966 | Newton | |
| 3,332,807 | A | 7/1967 | Boehmer et al. | |
| 4,448,032 | A | 5/1984 | Hibino et al. | |
| 4,487,024 | A | 12/1984 | Fletcher et al. | |
| 4,487,032 | A | 12/1984 | Speicher | |
| 4,831,840 | A | 5/1989 | Fletcher | |
| 4,848,102 | A | 7/1989 | Stanfill | |
| 4,916,921 | A | 4/1990 | Fletcher | |
| 5,032,157 | A | 7/1991 | Ruff et al. | |
| 6,003,319 | A | 12/1999 | Gilley et al. | |
| 6,293,107 | B1 | 9/2001 | Kitagawa et al. | |
| 6,401,461 | B1 | 6/2002 | Harrison et al. | |
| 6,412,286 | B1 | 7/2002 | Park et al. | |
| 6,735,959 | B1 * | 5/2004 | Najewicz | F25C 1/04 62/3.63 |
| 6,820,433 | B2 | 11/2004 | Hwang | |
| 6,908,163 | B1 | 6/2005 | Hebeler et al. | |
| 6,951,113 | B1 | 10/2005 | Adamski | |
| 7,000,407 | B2 | 2/2006 | Miozza et al. | |
| 7,188,479 | B2 | 3/2007 | Anselmino et al. | |
| 7,591,141 | B2 | 9/2009 | Wetekamp et al. | |
| 7,681,406 | B2 | 3/2010 | Cushman et al. | |
| 8,240,159 | B2 | 8/2012 | Prabhakar et al. | |
| 2002/0121096 | A1 | 9/2002 | Harrison et al. | |
| 2004/0012314 | A1 | 1/2004 | Hay et al. | |
| 2005/0061016 | A1 | 3/2005 | Lee et al. | |
| 2005/0252232 | A1 * | 11/2005 | Lee | F25D 17/065 62/340 |
| 2006/0075758 | A1 | 4/2006 | Rice et al. | |
| 2006/0096310 | A1 | 5/2006 | Lee | |
| 2006/0168983 | A1 | 8/2006 | Tatsui et al. | |
| 2006/0260325 | A1 | 11/2006 | Lin | |
| 2006/0260345 | A1 | 11/2006 | Coulter et al. | |
| 2006/0260350 | A1 | 11/2006 | Van Meter et al. | |
| 2006/0266059 | A1 | 11/2006 | Wetekamp et al. | |
| 2008/0059003 | A1 | 3/2008 | Doberstein et al. | |
| 2008/0072610 | A1 | 3/2008 | Venkatakrishnan et al. | |
| 2008/0141699 | A1 | 6/2008 | Rafalovich et al. | |
| 2009/0031750 | A1 | 2/2009 | Whillock, Sr. | |
| 2009/0049858 | A1 | 2/2009 | Lee et al. | |
| 2009/0151375 | A1 | 6/2009 | Tarr et al. | |
| 2009/0260371 | A1 | 10/2009 | Kuehl et al. | |
| 2009/0293501 | A1 | 12/2009 | Kulkarni et al. | |
| 2009/0302724 | A1 | 12/2009 | Allard et al. | |
| 2010/0018223 | A1 | 1/2010 | Sundhar | |
| 2010/0071384 | A1 | 3/2010 | Lu et al. | |
| 2010/0126185 | A1 | 5/2010 | Cho et al. | |
| 2010/0147003 | A1 | 6/2010 | Ueda et al. | |
| 2010/0167596 | A1 | 7/2010 | Yang | |
| 2010/0251730 | A1 | 10/2010 | Whillock, Sr. | |
| 2010/0326112 | A1 | 12/2010 | Prabhakar et al. | |
| 2011/0203305 | A1 | 8/2011 | Schenk et al. | |
| 2011/0232888 | A1 | 9/2011 | Sasaki | |
| 2011/0296863 | A1 | 12/2011 | Bergqvist et al. | |
| 2012/0118001 | A1 | 5/2012 | Mitchell et al. | |
| 2012/0167596 | A1 | 7/2012 | Krause et al. | |

FOREIGN PATENT DOCUMENTS

| | | | |
|---|---|---|---|
| EP | 1253387 | A1 | 10/2002 |
| EP | 1441188 | A1 | 7/2004 |
| EP | 1517103 | A2 | 3/2005 |
| EP | 1821051 | A1 | 8/2007 |
| EP | 2144023 | A1 | 4/2008 |
| EP | 2322887 | A2 | 5/2011 |
| EP | 2444761 | A2 | 4/2012 |
| JP | 2000161835 | A | 6/2000 |
| JP | 2006084135 | A | 3/2006 |
| KR | 20110064738 | A | 6/2011 |
| WO | 20080130712 | A1 | 10/2008 |
| WO | 2009025448 | A1 | 2/2009 |
| WO | 2009078562 | A1 | 6/2009 |
| WO | 2010058888 | A2 | 5/2010 |
| WO | 2011124440 | A1 | 10/2011 |

OTHER PUBLICATIONS

European Patent Office, "European Search Report," issued in connection with European Patent Application No. 13188928.9, dated Dec. 2, 2016, 8 pages.

European Patent Office, "European Search Report," issued in connection with European Patent Application No. 13188925.5, dated Dec. 14, 2016, 9 pages.

European Patent Office, "European Search Report," issued in connection with European Patent Application No. 13188923.0, dated Dec. 14, 2016, 12 pages.

European Patent Office, "European Search Report," issued in connection with European Patent Application No. 13173609.2, dated Aug. 29, 2016, 8 pages.

EP Search Opinion, EP2738493, dated Feb. 2, 2015.

EP Search Opinion, EP2738484, dated Feb. 23, 2015.

EP Search Opinion, EP2738485, dated Feb. 2, 2015.

EP Search Opinion, EP2738496, dated Feb. 2, 2015.

EP Search Opinion, EP2738497, dated Feb. 2, 2015.

Vian, J. et al., "Development of a Thermoelectric Ice Maker of Fingers Incorporated into a Static Domestic Refrigerator", 5th European Conference on Thermoelectrics, Sep. 10, 2007, pp. 1-6.

* cited by examiner

REFRIGERATOR WITH ICEMAKER CHILLED BY THERMOELECTRIC DEVICE COOLED BY FRESH FOOD COMPARTMENT AIR

CROSS-REFERENCE TO RELATED APPLICATIONS

The present application represents a divisional application of and claims priority to U.S. patent application Ser. No. 13/691,919 entitled "REFRIGERATOR WITH ICEMAKER CHILLED BY THERMOELECTRIC DEVICE COOLED BY FRESH FOOD COMPARTMENT AIR" filed Dec. 3, 2012, currently allowed.

FIELD OF THE INVENTION

The invention relates generally to refrigerators with icemakers, and more particularly to refrigerators with the icemaker located remotely from the freezer compartment.

BACKGROUND OF THE INVENTION

Household refrigerators commonly include an icemaker to automatically make ice. The icemaker includes an ice mold for forming ice cubes from a supply of water. Heat is removed from the liquid water within the mold to form ice cubes. After the cubes are formed they are harvested from the ice mold. The harvested cubes are typically retained within a bin or other storage container. The storage bin may be operatively associated with an ice dispenser that allows a user to dispense ice from the refrigerator through a fresh food compartment door.

To remove heat from the water, it is common to cool the ice mold. Accordingly, the ice mold acts as a conduit for removing heat from the water in the ice mold. When the ice maker is located in the freezer compartment this is relatively simple, as the air surrounding the ice mold is sufficiently cold to remove heat and make ice. However, when the icemaker is located remotely from the freezer compartment, the removal of heat from the ice mold is more difficult.

Therefore, the proceeding disclosure provides improvements over existing designs.

SUMMARY OF THE INVENTION

According to one exemplary embodiment, a refrigerator that has a fresh food compartment, a freezer compartment, and a door that provides access to the fresh food compartment is disclosed. An icemaker is mounted remotely from the freezer compartment. The icemaker includes an ice mold. A thermoelectric device is positioned in thermal communication with the icemaker. The thermoelectric device includes a cold side in thermal contact with the ice mold and a warm side. A fan is positioned to move air from the fresh food compartment across the warm side of the thermal electric device.

According to another embodiment, a method for cooling a refrigerator is disclosed. The refrigerator has a fresh food compartment, a freezer compartment and a door that provides access to the fresh food compartment. An icemaker is mounted remotely from the freezer compartment. The icemaker includes an ice mold. A thermoelectric device is located at the icemaker in thermal contact with the ice mold. The thermoelectric device has a warm side and an opposite cold side. The cold side is in thermal contact with the ice mold. Cool air from the fresh food compartment is moved across the warm side of the thermoelectric device for cooling the ice mold.

BRIEF DESCRIPTION OF THE DRAWINGS

While the specification concludes with claims particularly pointing out and distinctly claiming the invention, it is believed that the various exemplary aspects of the invention will be better understood from the following description taken in conjunction with the accompanying drawings, in which:

DETAILED DESCRIPTION OF THE PREFERRED EMBODIMENTS

Figure 1:
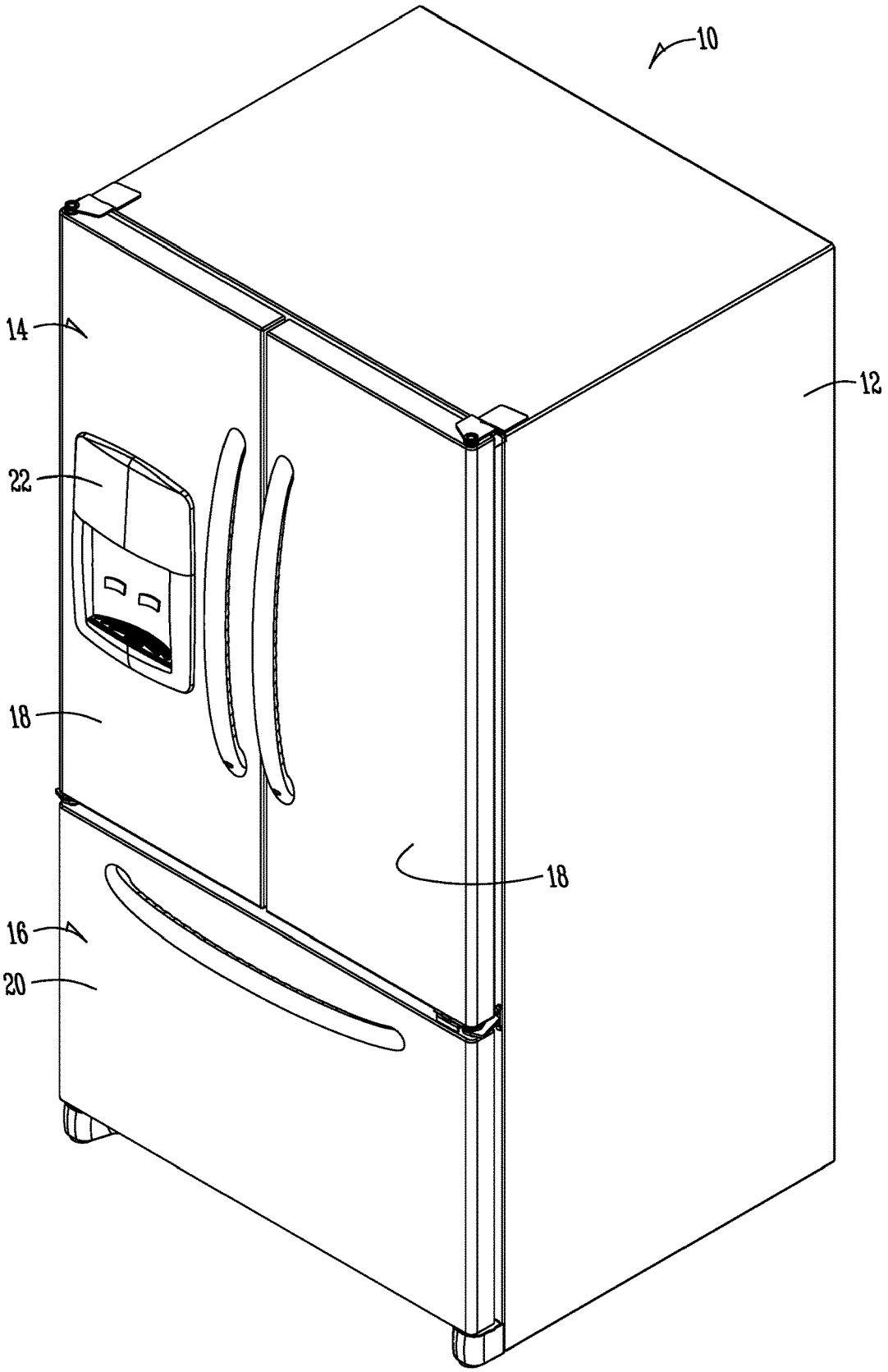
FIG. 1 is a perspective view illustrating exemplary aspects of a refrigerator.

Referring to the figures, there is generally disclosed in FIGS. 1-7 a refrigerator 10 configured to dispense ice from an icemaker 102 chilled by a thermoelectric device 50 cooled by air taken from the fresh food compartment or refrigerator compartment 14. The refrigerator 10 includes a cabinet body 12 with a refrigerator compartment or fresh food compartment 14 selectively closeable by a refrigerator compartment door 18 and a freezer compartment 16 selectably closeable by a freezer compartment door 20. A dispenser 22 is included on a refrigerator compartment door 18 for providing dispensions of liquid and/or ice at the refrigerator compartment door 18. Although one particular design of a refrigerator 10 is shown in FIG. 1 and replicated throughout various figures of the disclosure, other styles and configurations for a refrigerator are contemplated. For example, the refrigerator 10 could be a side-by-side refrigerator, a traditional style refrigerator with the freezer compartment positioned above the refrigerator compartment (top-mount refrigerator), a refrigerator that includes only a refrigerator or fresh food compartment and no freezer compartment, etc. In the figures is shown a bottom-mount refrigerator 10 where the freezer compartment 16 is located below the refrigerator compartment 14.

A common mechanism for removing heat from an icemaker 102, and thereby the water within the ice mold 106, is to provide cold air from the freezer compartment or freezer evaporator to the ice mold 106 by a ductwork or similar structure. However, such ductwork and fans taken from the freezer compartment or freezer evaporator can complicate construction and operation of the refrigerator, especially when the icemaker 102 is on a door.

A refrigerator 10, such as illustrated in FIG. 1 may include a freezer compartment 16 for storing frozen foods, typically at temperatures near or below 0° Fahrenheit, and a fresh food section or refrigerated compartment 14 for storing fresh foods at temperatures generally between 38° Fahrenheit and about 42° Fahrenheit. It is common to include icemakers and ice dispensers in household refrigerators. In a side-by-side refrigerator, where the freezer compartment and the fresh food compartment are located side-by-side and divided by a vertical wall or mullion, the icemaker and ice storage bin are generally provided in the freezer compartment and the ice is dispensed through the freezer door. In recent years it has become popular to provide so-called bottom mount refrigerators wherein the freezer compartment is located below the fresh food compartment, at the bottom of the refrigerator. It is advantageous to provide ice dispensing through the refrigerated compartment door 18 so that the dispenser 22 is at a convenient height. In bottom mount refrigerators the icemaker and ice storage may be provided within a separate insulated compartment 108 located generally within or adjacent to, but insulated from, the fresh food compartment.

To remove heat from the water, it is common to cool the ice mold 106 specifically. Accordingly, the ice mold 106 acts as a conduit for removing heat from the water in the ice mold. As an alternative to bringing freezer air to the icemaker, a thermoelectric device 50 may be used to chill the ice mold 106. The thermoelectric device 50 is a device that uses the Peltier effect to create a heat flux when an electric current is supplied at the junction of two different types of materials. The electrical current creates a component with a warm side 52 and cold side 54. Thermoelectric device 50 is commercially available in a variety of shapes, sizes, and capacities. Thermoelectric device 50 is compact, relatively inexpensive, can be carefully calibrated, and can be reversed in polarity to act as heaters to melt the ice at the mold interface to facilitate ice harvesting. Generally, thermoelectric device 50 can be categorized by the temperature difference (or delta) between its warm side 52 and cold side 54. In the ice making context this means that the warm side 52 must be kept at a low enough temperature to permit the cold side 54 to remove enough heat from the ice mold 106 to make ice at a desired rate. Therefore, the heat from the warm side 52 of the thermoelectric device 50 must be removed to maintain the cold side 54 of the mold sufficiently cold to make ice. Removing enough heat to maintain the warm side 52 of the thermoelectric device 50 at a sufficiently cold temperature creates a challenge.

An additional challenge for refrigerators where the icemaker is located remotely from the freezer compartment is the storage of ice after it is harvested. One way for retaining the ice in such situations is to provide an insulated compartment or bin 108 and to route the cold air used to chill the ice mold 106 to cool the ice.

Figure 2:
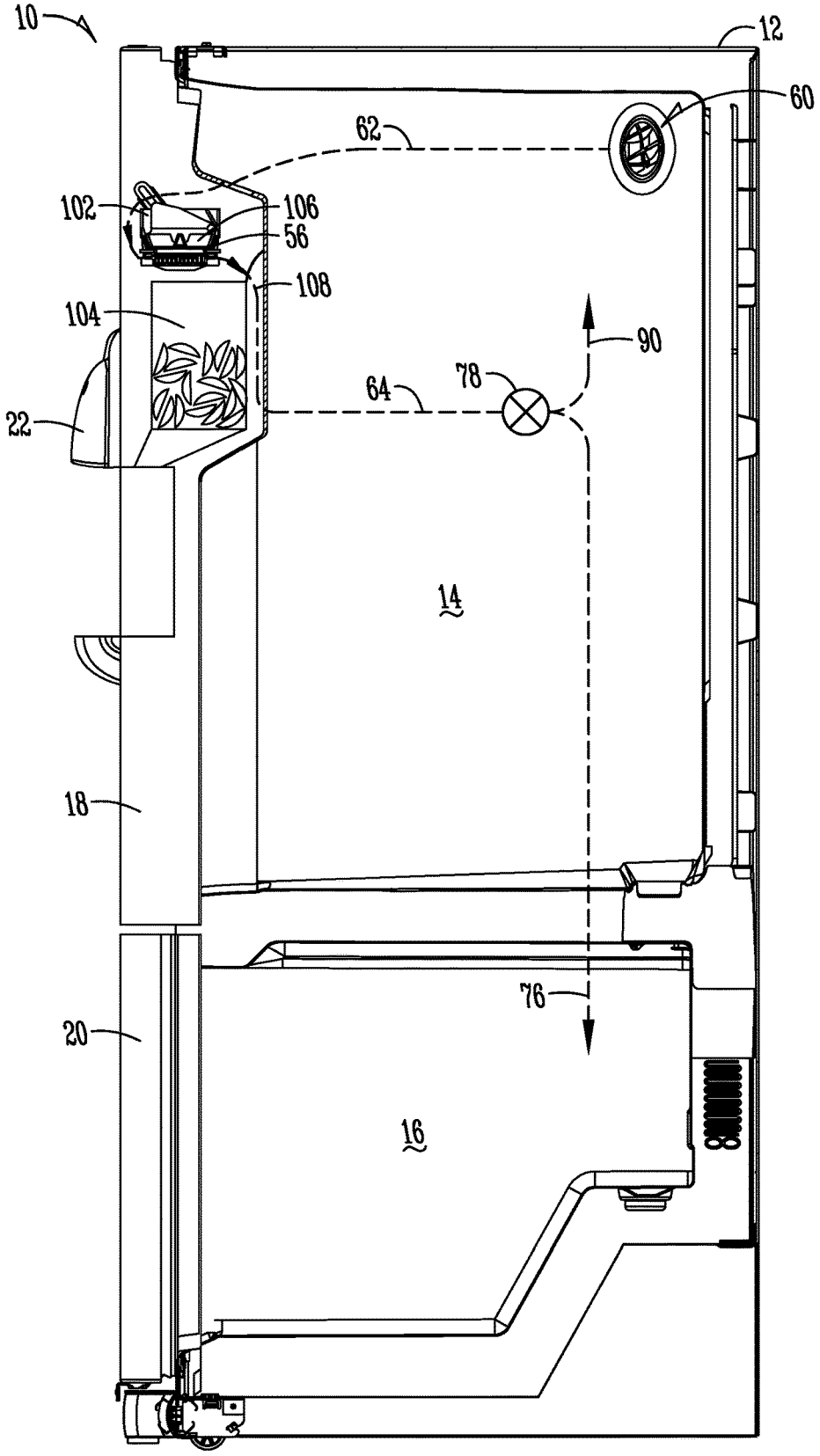
FIG. 2 is a side elevation view showing a sectional of the refrigerator illustrated in FIG. 1.
Figure 3:
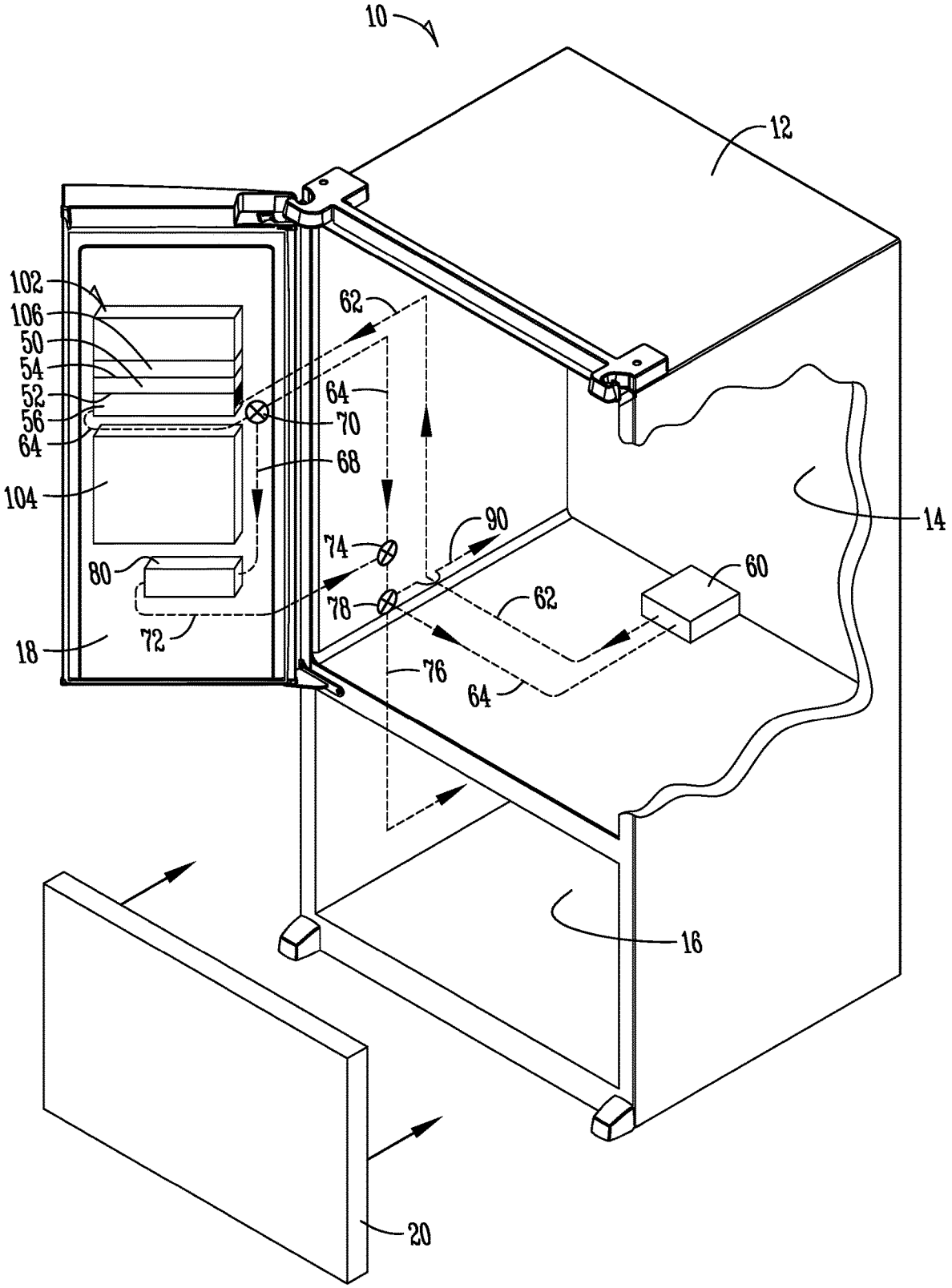
FIG. 3 is a perspective illustration with a cutout for viewing exemplary aspects of the refrigerator.

Several aspects of the disclosure addressing the aforementioned challenges are illustrated in the sectional and cutout views of refrigerator 10 shown in FIGS. 2 and 3. In connection with the dispenser 22 in the cabinet body 12 of the refrigerator 10, such as for example in the refrigerator compartment door 18 is an icemaker 102 having an ice mold 106 for extracting heat from liquid within the ice mold to create ice which is dispensed from the ice mold 106 into an ice storage bin 104. The ice is stored in the ice storage bin 104 until dispensed from the dispenser 22. The ice mold 106 or ice maker 102 may include an air sink for extracting heat from the ice mold 106 using air as the extraction medium. Alternatively, a liquid sink (not shown) may be operably connected in thermal contact with the ice mold 106 for extracting heat from the ice using fluid as the extraction medium. In another aspect, heat from the warm side of the thermoelectric device 50 may be radiated off of the air sink into ambient air. In such an embodiment, air may not need to be communicated from the refrigerator compartment 14 to the refrigerator compartment door 18 for extracting heat off the warm side 52 of the thermoelectric device 50. Thus, only the energy used to power the thermoelectric device 50 may be required to chill the ice mold 106. According to another embodiment of the disclosure, an air supply pathway 62 is connected between the icemaker 102 and a fan 60 located, for example, in the refrigerated compartment 14. An air return pathway 64 may also be connected between the icemaker 102 and the refrigerated compartment 14 and/or freezer compartment 16. The air supply pathway 62 and the air return pathway 64 together may be configured to form an air loop connecting the icemaker 102 with the fan 60. The air supply pathway 62 and air return pathway 64 could also be configured as fluid pathways (e.g., a fluid supply pathway and a fluid return pathway) connected between the icemaker 102 and refrigerated compartment 14. The pathway 62, 64 may include a conduit, line, ductwork, or other enclosed flow path to facilitate the transfer of a heat carrying medium (e.g., air or a heat carrying fluid such as glycol) between the icemaker 102 and the fan 60 (or pump for a fluid heat carrying medium).

In one aspect of the invention, air supply pathway 62 and air return pathway 64 are connected to an air sink 56 positioned in thermal contact with the warm side 52 of the thermoelectric device 50. The air sink 56 provides a thermal transfer pathway between the heat carrying medium and the warm side 52 of the thermoelectric device 50. In the case of a clear ice process, the air sink may be configured to move with the ice mold 106. Thus, the air pathway may be configured with a plenum box with direction fins for evenly distributing air across the fins of the air sink 56 while it rocks from side-to-side. This could be accomplished by communicating air or fluid through a rocking carriage in sealed communication with the box plenum whereby the ice mold 106 and sink along with the carriage rock from side-to-side within the plenum carrying the air or fluid across the fins of the sink (e.g., air sink or fluid sink). The cold side 54 of the thermoelectric device 50 is kept generally at a temperature below the temperature required for making ice (e.g., temperatures near or below 0° Fahrenheit). Conversely, the warm side 52 of the thermoelectric device is operated at a temperature of the desired temperature for making ice plus the delta for the thermoelectric device. For example, if the delta for the thermoelectric device 50 is 20° Fahrenheit, the warm side 52 of the thermoelectric device 50 must be kept at a temperature less than 52° Fahrenheit to maintain the cold side 54 of the thermoelectric device 50 at 32° Fahrenheit or below. An electrical current is provided to the thermoelectric device 50 which provides the necessary Peltier effect that creates a heat flux and provides a cold side 54 and warm side 52 during operation. To dissipate heat from the warm side 52 of the thermoelectric device 50, the air sink 56 is configured in operable thermal operation/contact with the warm side 52 of the thermoelectric device 50. An air supply pathway 62 is connected between the air sink 56 and a fan 60 positioned within the refrigerator compartment 14 of the refrigerator 10. An air return pathway 64 is connected between the air sink 56 and the refrigerator compartment 14 and/or freezer compartment 16 selectable by operation of flow controller 78.

Fluid as a heat carrying medium is known to be more efficient than air; therefore, one embodiment of the refrigerator 10 may include a fluid supply pathway configured to communicate a cool fluid from the refrigerator compartment 14 to a fluid sink positioned in thermal contact with the warm side 52 of the thermoelectric device 50. A fluid return pathway may also be configured across the refrigerator compartment door 18 and the refrigerator compartment 14. Together, the supply and return fluid pathways may be configured as a fluid loop between the refrigerated compartment 14 and the refrigerator compartment door 18. The fluid in the loop may comprise a glycol, such as ethylene glycol. The fluid pathway may be a conduit, tube, duct, channel, or other fluid carrying member. A flexible fluid carrying member may be used across the junction between the refrigerator compartment door 18 and the refrigerator compartment 14 to allow the member to move/adjust with opening and closing the refrigerator compartment door 18. The icemaker 102 and ice storage bin 104 may also be positioned on the insulated compartment 108. The wall of the insulated compartment 108 may be configured to separate from the refrigerator compartment door 18 to allow the door to be removed without having to remove the insulated compartment 108, which allows the fluid pathway to remain connected regardless whether the refrigerator compartment door 18 is removed. In another configuration, junctions may be provided fluid connections between the refrigerator compartment door 18 and the refrigerator compartment 14 to facilitate separation of the refrigerator compartment door 18 from the cabinet body 12 of the refrigerator 10. The fluid carrying member may also be configured into a hinge supporting the refrigerator compartment door 18. The disclosure also contemplates that a fluid supply pathway may be configured to supply cold fluid from the freezer compartment 16. The use of fluid as the heat carrying medium has several benefits. Generally, the fluid carrying member (e.g., tube) is less likely to sweat or cause condensation to form. Fluid has a greater heat carrying capacity (compared to air) meaning that less overall volume (e.g., fluid carrier volume) is required to carry more (again, compared to air). Fluid also has a higher thermal conductivity and is able to harvest heat from a fluid sink made from, for example, aluminum or zinc diecast faster than air even for smaller volumetric flows. Fluid pumps are also generally more efficient and quiet than air pumps that cost generally the same amount. Using a fluid like glycol also increases the above-described efficiencies, over for example, using air as the heat carrier.

Figure 4:
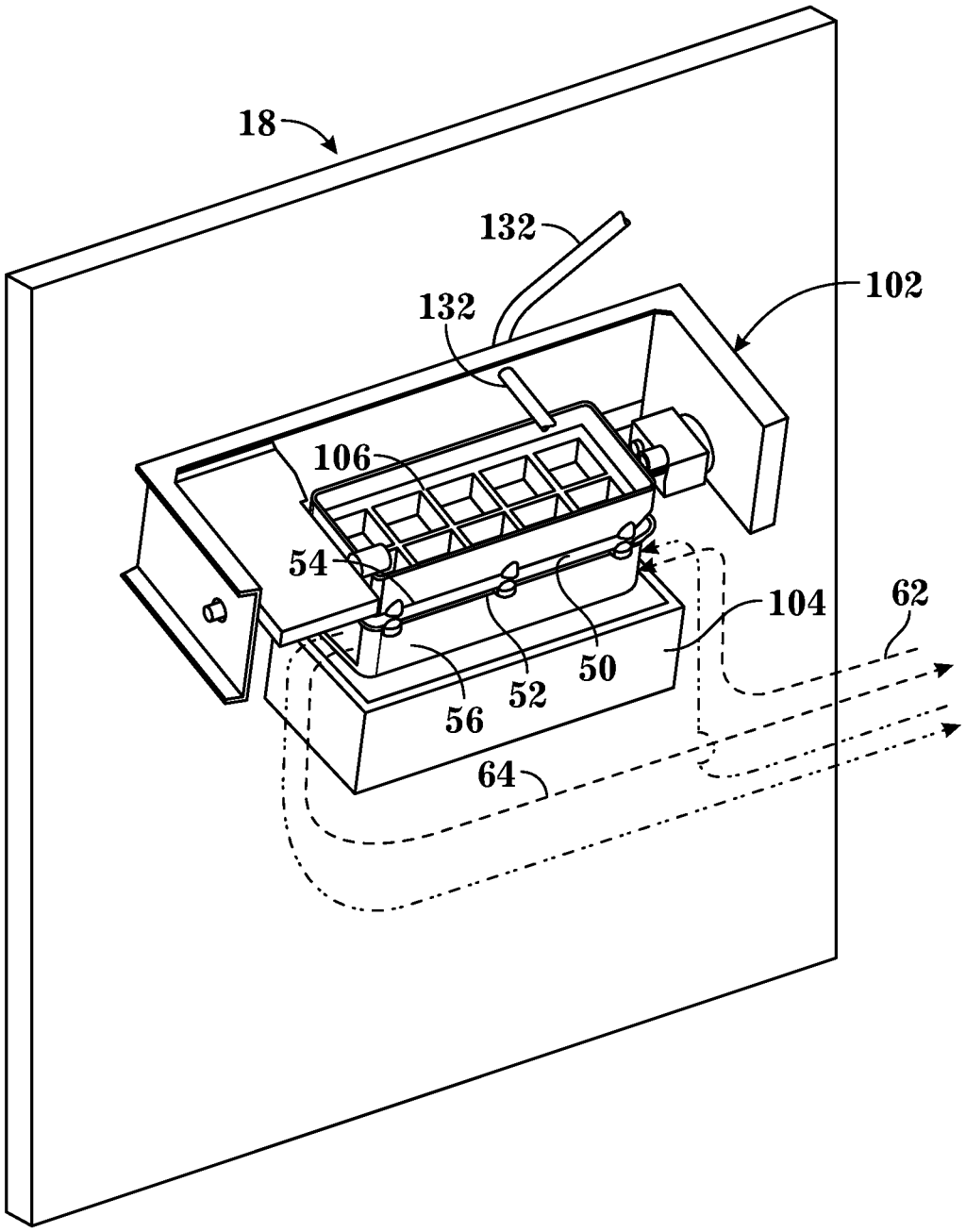
FIG. 4 is a perspective view of an exemplary configuration for the inside of a refrigerator compartment door.

In a typical refrigerator, the refrigerator compartment 14 is kept generally between 38° Fahrenheit and about 42° Fahrenheit. A fan 60 or other means for moving air through a ductwork or other defining channel may be positioned within the refrigerator compartment 14 at a location such as adjacent the horizontal mullion that separates the refrigerator compartment 14 from the freezer compartment 16. Other embodiments are contemplated where the fan is positioned elsewhere within the refrigerated compartment 14. For example, the fan 60 may be positioned within a mullion or sidewall of the cabinet body 12 of the refrigerator 10. Positioning the fan 60 adjacent the mullion that separates the refrigerator compartment from the freezer compartment may draw upon the coolest air within the refrigerator compartment 14 given that cooler air within the refrigerator compartment 14 is generally located closer to or adjacent the horizontal mullion that separates the refrigerator compartment 14 from the freezer compartment 16. The cool air may also be ducted out of the refrigerator compartment 14 through an air supply pathway 62 using fan 60. The fan may also be positioned within the insulated compartment 108 on the refrigerator compartment door 18. The cool air pumped to the air sink 56 may be exhausted back into the refrigerator compartment 14 and/or into the freezer compartment 16. A flow controller 78 may be provided within the air return pathway 64 to direct flow through an air return pathway 90 that exhausts into the refrigerator compartment 14 or an air return pathway 76 that exhausts into the freezer compartment 16. The disclosure contemplates that other pathways may be configured so that air from the air return pathway 64 is communicated to other locations within the cabinet body 12 of the refrigerator 10. For example, the air within the air return pathway 64 may be communicated to a discreet, or desired space within the refrigerator compartment 14 or freezer compartment 16. A separate cabinet, bin or module within the freezer compartment 16 or refrigerator compartment 14 may be configured to receive air exhausted from the thermoelectric device 50 through one or more of the air return pathways 64, 76, 90. A junction may be provided in the air supply pathway 62 at the interface between the refrigerator compartment door 18 and the refrigerator compartment 14. The interface (not shown) between the refrigerator compartment 14 and refrigerator compartment door 18 is sealed and separated upon opening and closing the refrigerator compartment door 18. Alternatively, the air supply pathway 62 may be configured through another attachment point of the refrigerator compartment door 18 such as a hinge point generally at a top or bottom portion of the door. The air supply pathway 62 may also be configured from a flexible conduit that extends between the refrigerated compartment 14 and refrigerated compartment door 18 that allows the door to be opened and closed while keeping the pathway intact. Thus, cool air from the refrigerator compartment 14 is communicated through the air supply pathway 62 to the air sink 56 of the thermoelectric device 50. The air temperature ranges generally between 38° Fahrenheit and about 42° Fahrenheit (i.e., the temperature of the refrigerator compartment) depending upon the delta rating of the thermoelectric device 50 the temperature on the cold side 54 of the thermoelectric device 50 ranges anywhere from about 38° Fahrenheit to 42° Fahrenheit minus the temperature delta of the thermoelectric device. Assuming the refrigerator compartment is set at 38° Fahrenheit and the thermoelectric device has a delta of 10 degrees, the cold side 54 of the thermoelectric device 50 may operate at 28° Fahrenheit. The liquid in the ice mold 106 is generally then at the temperature of the cold side 54 of the thermoelectric device 50. Heat from the ice mold 106 is extracted and carried away from the icemaker 102 through the thermoelectric device 50 and air return pathway 64. Depending upon the desired rate of production of ice, the flow rate of air through the air supply pathway 62 and the operating parameters of the thermoelectric device 50 may be controlled so that the warm side 52 and cold side 54 of the thermoelectric device 50 are kept at the desired operating temperatures so that ice production can be maintained at a desired rate of production by extracting heat from the ice mold 106 of the icemaker 102 at a rate that is capable of sustaining the desired level of ice production. The rate of operation for these various components may be controlled to use the least amount of energy necessary for keeping up with the desired rate of ice production. As illustrated in FIG. 4, the air sink 56 may include a plurality of fins to allow heat to be dissipated from the warm side 52 of the thermoelectric device 50 using air from the refrigerator compartment 14 to pass through the air supply pathway 62 and return to the refrigerator compartment or freezer compartment through the air return pathway 64.

The air supply pathway 62 and/or air return pathway 64 may also be configured to communicate air to one or more secondary or tertiary heating/cooling applications on the door, such as illustrated in FIG. 3. The warming/cooling application 80 may include a reservoir for storing cold or warm fluids. For example, an air supply pathway 68 may be connected between the application 80 and the air return pathway 64 carrying warm air from the warm side 52 of the thermoelectric device 50 to the application 80. The warm air may be used to warm a fluid (e.g., a water reservoir or water ducts) in the application 80; the warm water may be communicated to the dispenser 22 for dispensing warm water, to the icemaker 102 for purging the ice mold 106, or to another application that may benefit from the use of warm water. The flow of warm air through the air supply pathway 68 may be controlled by a flow controller 70 in operable communication with the air return pathway 64. The flow of air from the application 80 to the air return pathway 64 may also be controlled by a flow controller 74 or baffle configured into the air return pathway 64. In a cooling mode (e.g., reversing the polarity of the thermoelectric device 50), the application 80 may be used to cool water (e.g., a water reservoir or water ducts); the chilled water may be communicated to the dispenser 22 for dispensing chilled water, to the icemaker 102 for filling the ice mold 106, or to another application that may benefit from the use of chilled water. In both scenarios, the chilled water/fluid or warm water/fluid may be communicated to an end-use application or process on the refrigerator compartment door 18, in the refrigerator compartment 14 or in the freezer compartment 16. For example, warm/chilled fluid may be used to warm/chill a drawer, bin, compartment, shelf or other defined area within an environment of the refrigerator 10. Warm fluid or chilled fluid may also be used for controlled defrosting of a food item in a drawer or the evaporator coils, or for controlling condensation or sweating on an exterior panel or interior panel exposed intermittently to ambient air (e.g., insulated compartment 108 on the refrigerator compartment door 18).

A refrigerator compartment door 18 configured to illustrate an exemplary aspect of refrigerator 10 is shown in FIG. 4. The door may be a refrigerator compartment door 18 such as illustrated in FIGS. 1-3. The various components illustrated in FIG. 4 may be housed within an insulated compartment 108 such as illustrated in FIG. 2. As previously illustrated and described, the thermoelectric device 50 includes an air sink 56 configured to receive air through an air supply pathway 62 connected between the thermoelectric device 50 and a fan 60 in the refrigerator compartment 14 or on the door of the refrigerator 10. Air passing through the air sink 56 dissipates heat from the warm side 52 of the thermoelectric device 50. The warm air may be communicated through an air return pathway 64 to the refrigerator compartment 14 and/or freezer compartment 16. A flow controller 78 or damper may be configured in the air return pathway 64 for selectively controlling the flow of warm air between the compartments 14/16. For example, in the case where the warm air has a temperature generally above 50° Fahrenheit it may be best to return the warm air to the freezer compartment 16 instead of the refrigerator compartment 14 to prevent wild temperature swings in the refrigerator compartment 14. The warm air may also be communicated to a warming drawer (not shown) within but insulated from the refrigerator compartment 14 to warm the temperature in the drawer to a temperature generally above the temperature of the refrigerator compartment 14. For example, the drawer or bin may be kept at a temperature of 55° Fahrenheit, which is generally suitable for food items such as potatoes. The warm air could also be used to change the dew point in the refrigerator compartment 14 or within a drawer or bin (not shown) housed within the refrigerator compartment 14 or on the refrigerator compartment door 18. The warm air may also be communicated to a surface of the refrigerator 10 for purposes of evaporating moisture on the surface and/or to keep certain surfaces from sweating. According to one aspect of the invention, warm air may be communicated through an air supply pathway 62 connected between the fan 60 and the ice maker 102. Ductwork or other channels of communication may be provided within the refrigerator compartment door 18 or within the insulated compartment 108 for communicating air between the door and the icemaker 102. During an icemaking process, water is dispensed through a fill tube 132 for filling the ice mold 106. Heat is extracted from the water in the ice mold 106 for making ice. During an ice harvesting cycle, warm air from the air sink 56 may be communicated through an air supply pathway (not shown) to the ice mold 106 to assist in the ice harvesting process whereby the ice mold 106 is warmed to a temperature to create a thin fluid layer between the frozen ice and the ice mold to allow each of the cubes to release from the ice mold during harvesting. One or more ducts or channels may be configured within the ice mold 106 to direct the flow of warm air within the air supply pathway to specific regions or locations within the icemaker 102. An air supply pathway may also be configured to communicate warm air through one or more ducts positioned adjacent to or in thermal contact with the ice mold 106 for warming the ice mold 106 by convection or conduction.

Figure 5:
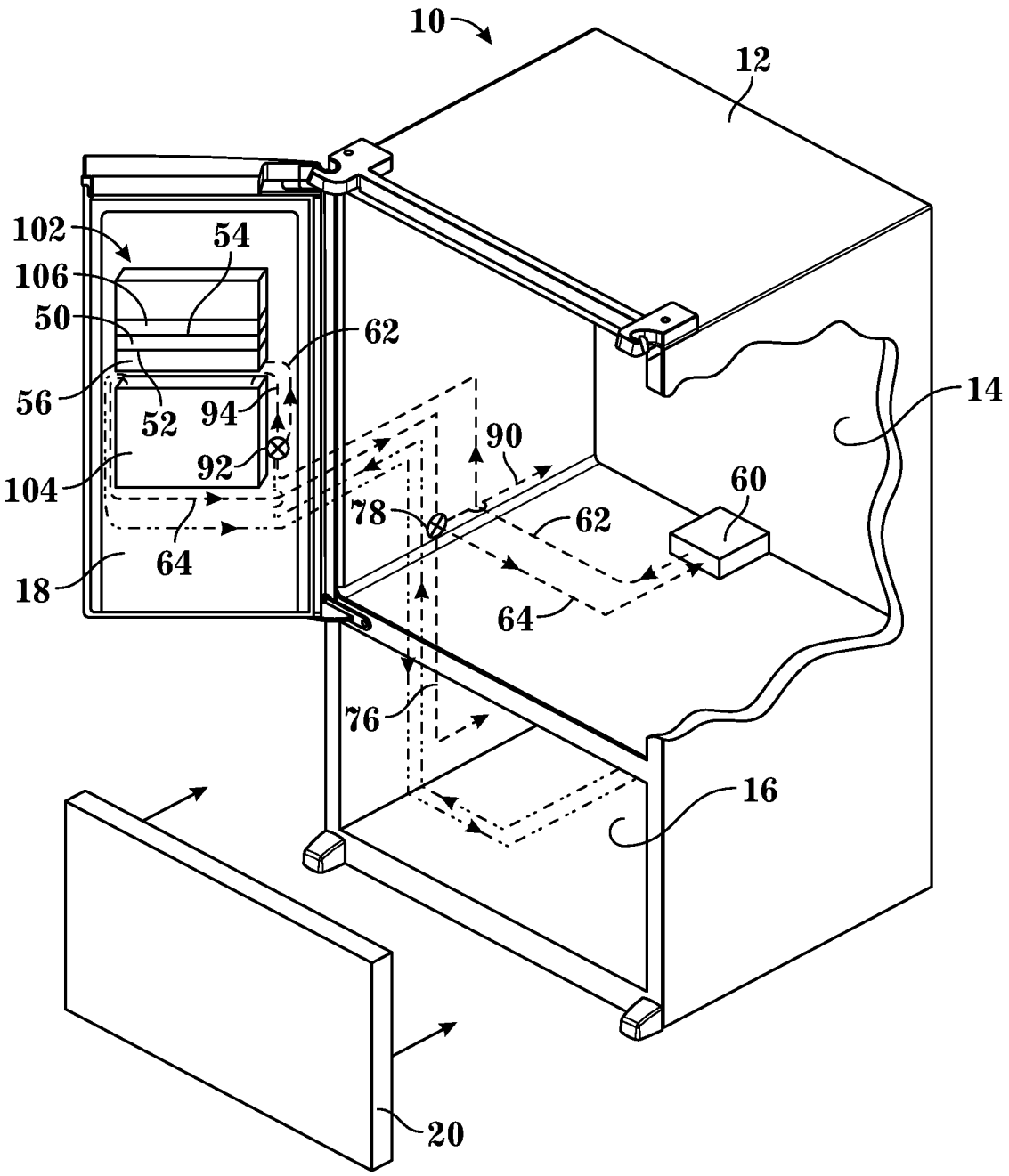
FIG. 5 is another perspective illustration with a cutout for viewing exemplary aspects of the refrigerator.

In addition to cooling the ice mold 106, the air supply pathway 62 originating at the fan 60 may be configured with a flow controller 92 (as shown in FIG. 5) for selectively communicating the cold air through air supply pathway 94 to the ice storage bin 104 or through ductwork located within the sidewalls of the ice storage bin 104. The flow controller 92 may be operated to dampen the flowrate of air or fluid to the ice storage bin 104 to control the rate of ice melt in the bin. The flow controller 92 may be operated to allow both simultaneously cooling of the ice mold 106 through air supply pathway 94 and the ice storage bin 104 through air supply pathway 62 (to the extent the demand on the thermoelectric device 50 does not exceed its operating capabilities). Thus, the ability to extract heat using air from the refrigerator compartment 14 for cooling the thermoelectric device 50 may be used to provide cooling to other operations on the refrigerator compartment door, as illustrated for example in FIG. 5.

Figure 6:
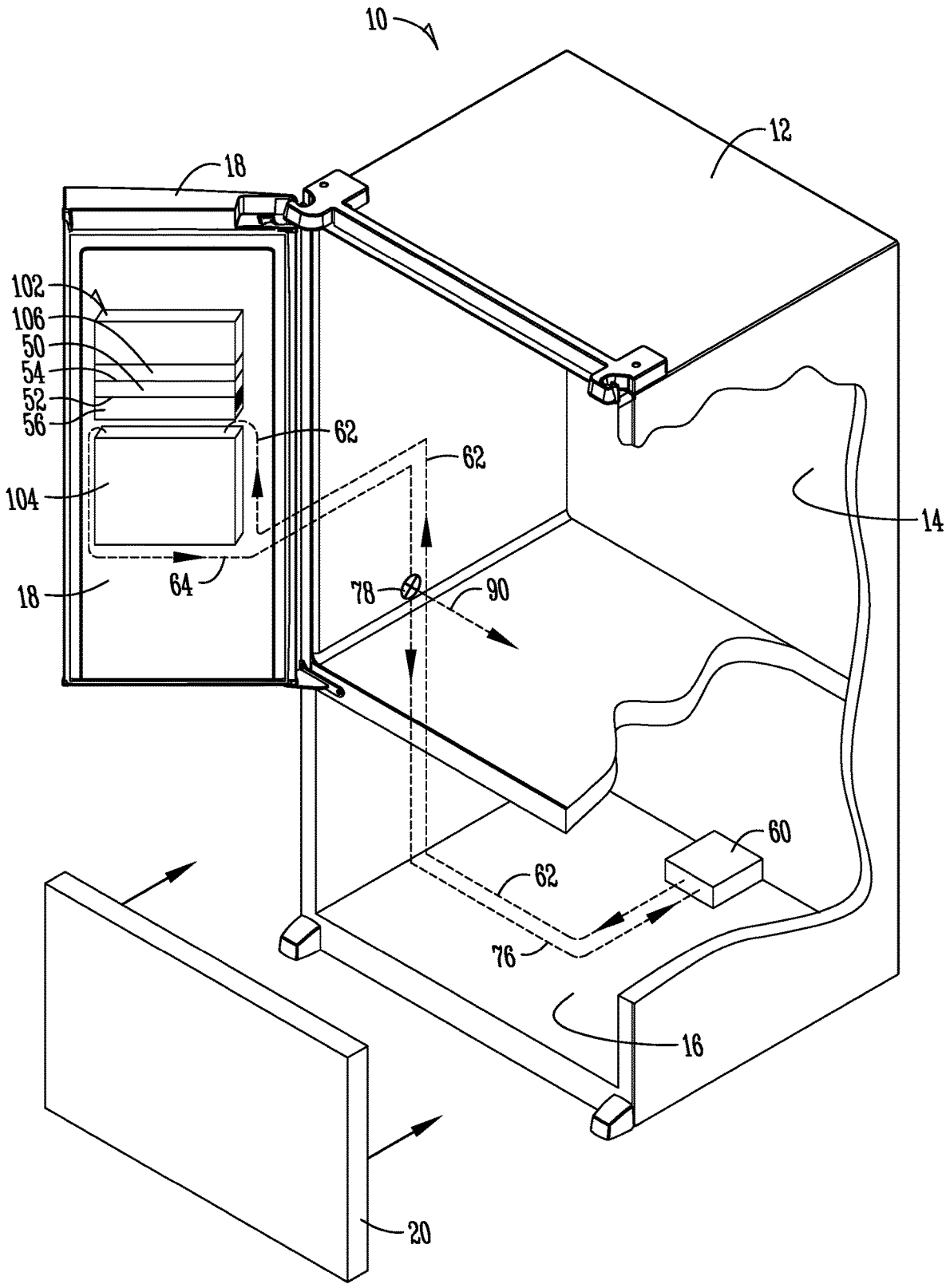
FIG. 6 is another perspective illustration with a cutout for viewing other exemplary aspects of the refrigerator.

FIG. 6 illustrates another possible cooling application according to an exemplary aspect of the refrigerator 10. Aspects of the disclosure, such as those illustrated in FIG. 6, may provide for possible cooling and/or heating applications on, for example, a refrigerator compartment door 18 of a refrigerator 10. As indicated previously, the thermoelectric device 50 has a warm side 52 and a cold side 54. The cold side is in thermal contact with the ice mold 106 and the warm side is in thermal contact with the air sink 56. Reversing the polarity of the thermoelectric device 50 changes the warm side 52 to a cold side and the cold side 54 to a warm side. The thermoelectric device 50 may be operated in two modes, namely the mode illustrated in FIG. 3 and in a mode where the warm and cold sides are switched. In the mode illustrated in FIG. 3, the cold side 54 is in thermal contact with the ice mold 106 and the warm side 52 is in thermal contact with the air sink 56. Alternatively, by switching the polarity of the thermoelectric device 50, the warm side 52 may be changed to be in thermal contact with the ice mold 106 and the cold side changed to be in thermal contact with the air sink 56. The warm side 52 may be used to warm the ice mold 106 for ice harvesting. Cold air from the cold side 54 of the thermoelectric device 54 may be communicated to the ice storage bin 104 or a cooling application (e.g., Such as the applications discussed above; for example, see discussion relating to application 80).

Figure 7:
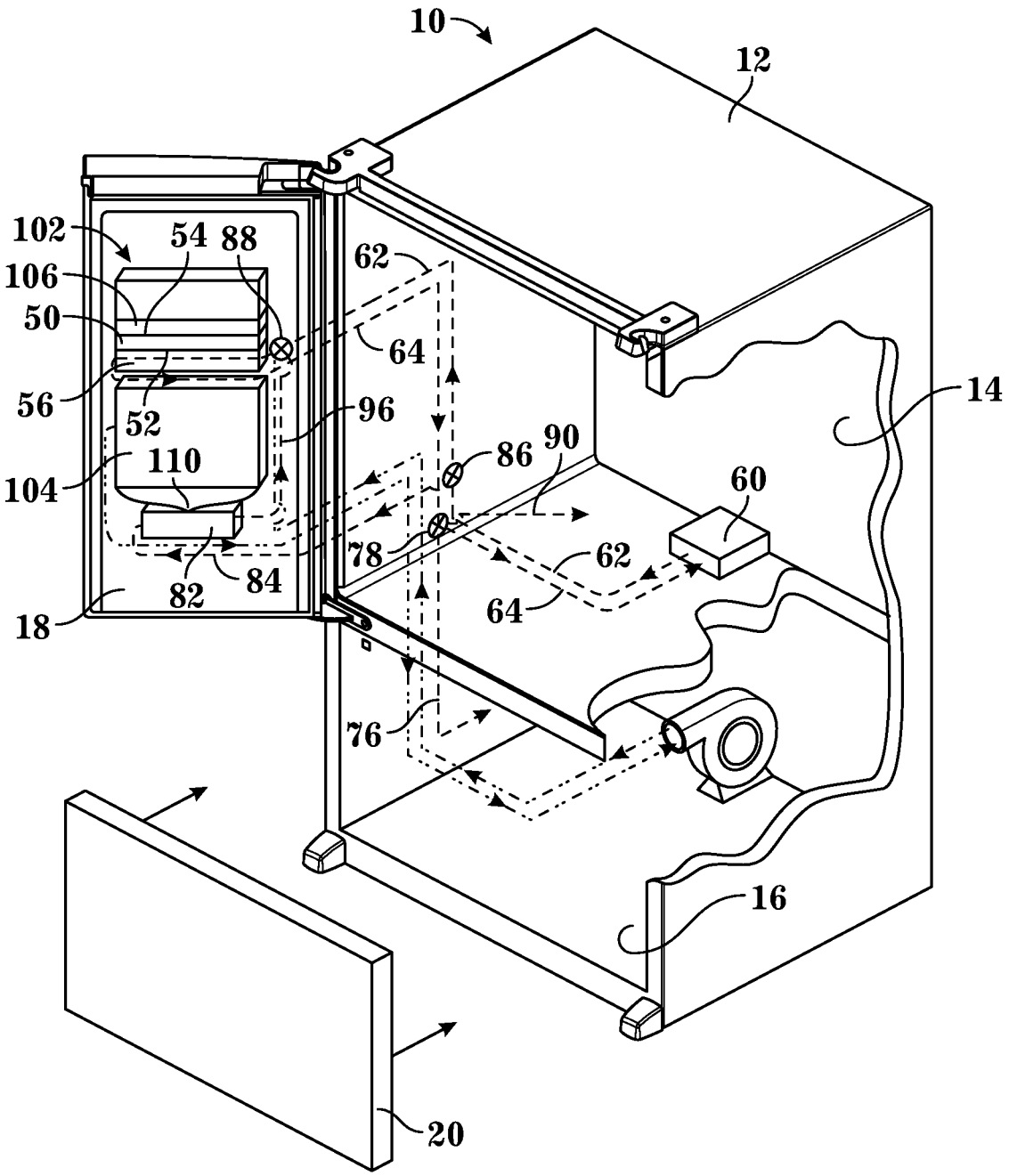
FIG. 7 is perspective illustration with a cutout for viewing another exemplary aspects of the refrigerator.

FIG. 7 illustrates another exemplary aspect of refrigerator 10. In FIG. 7 an air supply pathway 84 is connected between air supply pathway 62 and cooling application 82. A flow controller 86 may be configured in air supply pathway 62 to control flow through air supply pathway 84. The flow controller 86 allows dampening of flow through air supply pathway 62 and air supply pathway 84. An air supply pathway 96 may also be configured between the cooling application 82 and air supply pathway 62. A flow controller may be configured in air supply pathway 62 for controlling flow through air supply pathway 96. The flow controller 88 may be configured to provide dampening of flow through air supply pathway 96. In this configuration, cool air from fan 60 flows through the cooling application 82 and returns to air supply pathway 62. The cooling application 82 may be configured with a fluid reservoir for collecting cold ice melt from ice storage bin 104. And air sink (not shown) may be included in the cooling application 82 for extracting heat from air passing through the air supply pathways 84 and 96. The air passing through the cooling application 82 is cooled at or close to the temperature of the cold ice melt. For example, the refrigerator compartment air maybe cooled several degrees to the temperature of the cold ice melt temperature. The chilled air may then be communicated to the thermoelectric device 50 for removing heat from the warm side 52 of the device. The further cooling of the refrigerator compartment air allows the thermoelectric device 50 to operate more efficiently and at lower temperatures. The flow controllers 86 and 88 may be used to dampen the flow to the thermoelectric device 50 depending upon the desired inlet temperature of the airflow across the warm side 52 of the thermoelectric device 50. A water reservoir (not shown) could be included in the cooling application 82. A fluid sink (not shown) in the cooling application 82 could be used to chill water in the water reservoir using cold ice melt from the ice storage bin 104. Water (e.g., drinkable/consumable) may be communicated from the reservoir to the dispenser 22 or to the icemaker 102. The chilled water communicated to the icemaker 102 may decrease the time and energy required to freeze the water in the ice mold 106 compared to water at ambient or refrigerator compartment temperatures. A fluid heat carrying medium may also be used in flow pathways for accomplishing the same objectives describing the illustration in FIG. 7. For example, fluid may be communicated from the refrigerator compartment 14 to the icemaker 102. Cold melt water from the ice storage bin 104 collected from the drain 110 may be used to further chill the fluid from the refrigerator compartment before being passed through a fluid sink (not show, but could replace air sink 56) in thermal contact with warm side of the thermoelectric device 50. The rate of ice melt could also be controlled by allowing the ice storage bin 104 to be uninsulated from the refrigerator compartment 14, thereby permitting more ice to melt as opposed to less. The warm fluid could be communicated back to the refrigerator compartment 14 through a return pathway. The fan 60 could be replaced with a pump for supplying fluid from the refrigerator compartment 14 to the refrigerator compartment door 18. The configuration illustrated in FIG. 7 could also designed so that cold melt water collected from drain 110 in the cooling application 82 is used in combination with cool air from the refrigerator compartment 14 to extract heat from off the warm side 52 of the thermoelectric device 50. Thus, in a hybrid scenario, both chilled fluid and cooled air may be used simultaneously to cool the thermoelectric device 50.

Figure 8:
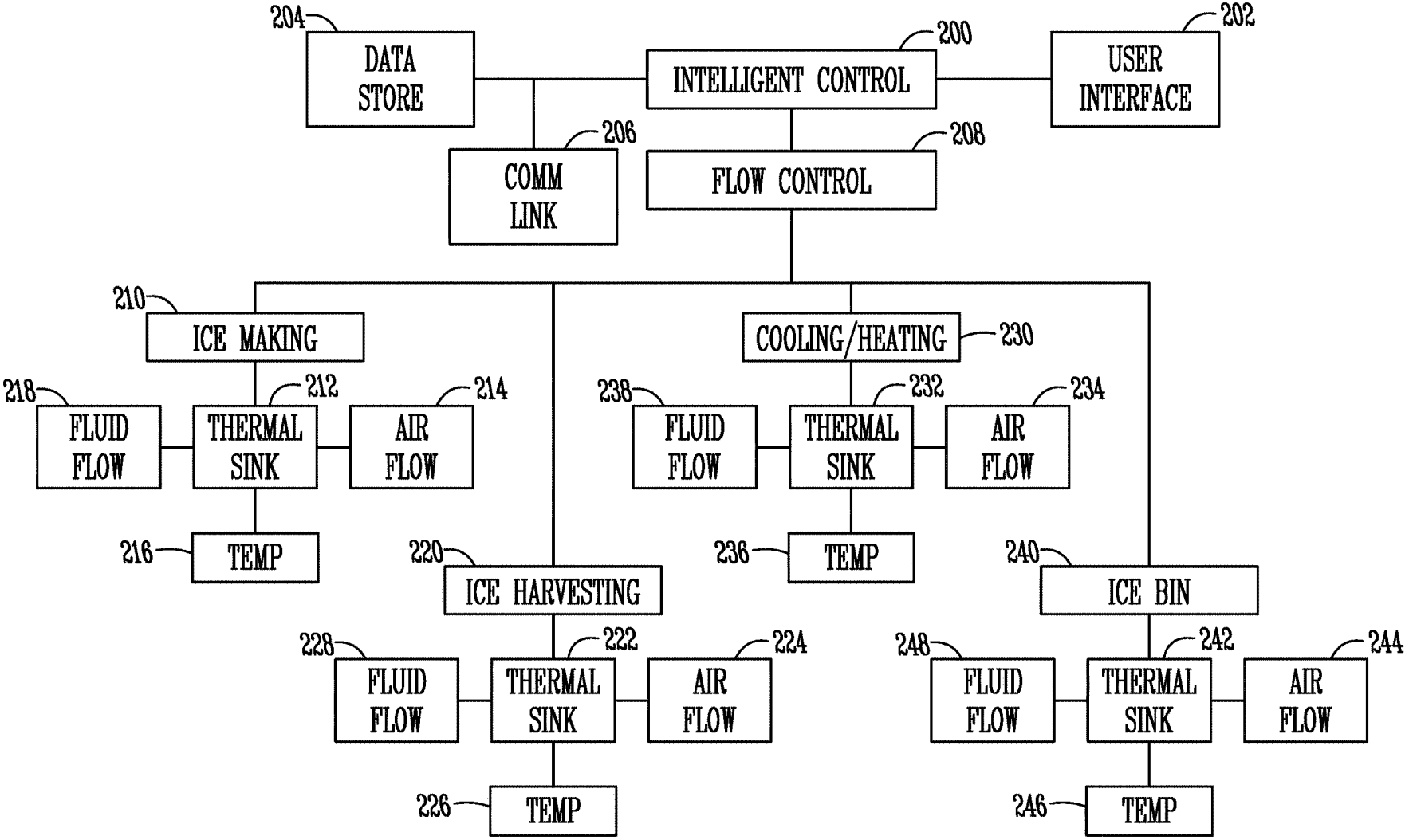
FIG. 8 is a flow diagram illustrating a process for intelligently controlling one or more operations of the exemplary configurations of the refrigerator.

FIG. 8 provides a flow diagram illustrating control processes for exemplary aspects of the refrigerator. To perform one or more aforementioned operations or applications, the refrigerator 10 may be configured with an intelligent control 200 such as a programmable controller. A user interface 202 in operable communication with the intelligent control 200 may be provided, such as for example, at the dispenser 22. A data store 204 for storing information associated with one or more of the processes or applications of the refrigerator may be provided in operable communication with the intelligent control 200. A communications link 206 may be provided for exchanging information between the intelligent control 200 and one or more applications or processes of the refrigerator 10. The intelligent control 200 may also be used to control one or more flow controllers 208 for directing flow of a heat carrying medium such as air or liquid to the one or more applications or processes of the refrigerator 10. For example, in an ice making application 210 the flow controller 208 and intelligent control 200 control and regulate the air flow 214 from the refrigerator compartment 14 to the thermal sink process 212. The thermal sink process 212 controls the temperature 216 of the fluid flow 218 to the ice making process 210. The rate at which the air flow 214 moves air from the refrigerator compartment 14 to the thermal sink process 212 for controlling the temperature 216 may be controlled using the intelligent control 200 in operable communication with one or more flow controllers 208. The rate of fluid flow 218 to the ice making process 210 (e.g., water communicated from the cooling application 82) may also be controlled by the intelligent control 200 operating one or more flow controllers 208. For example, the air flow process 214 may be provided by intelligent control 200 of a fan or other pump mechanism for moving air flow from the refrigerator compartment 14 to the thermal sink process 212. The intelligent control 200 may also be used to control the pump used to control fluid flow 218 from the cooling application 82 to the ice making process 210 or dispenser 22. The rate at which the pump and the fan operate to control air flow 214 and fluid flow 218 may be used to control the temperature 216 of a thermal sink process 212 (e.g., rate of the ice making process 210). The intelligent control 200 may also be used to control the ice harvesting process 220. One or more flow controllers 208 under operation of the intelligent control 200 may be used to control air flow 224 to the thermal sink process 222 and ice harvesting process 220. For example, the intelligent control 200 may be used to control the temperature 226 of the air flow 224 to enable the ice harvesting process 220. Intelligent control 200 may also be used to control one or more flow controllers 208 to decrease the temperature 226 of the air flow 224 (e.g., by supplementing chilling with the cooling application 82) to the ice harvesting process 220 for chilling the ice mold and increasing the rate of ice production. The temperature 226 of the fluid flow 228 and/or the air flow 224 may be controlled using the thermal sink process 222 for warming ice within the ice bin (e.g., by communicating refrigerator compartment air to the ice storage bin 104) to provide a fresh ice product depending upon an input at the user interface 202. In another aspect of the invention, the intelligent control 200 may be used to control cooling and heating applications 230, such as for example, on the refrigerator compartment door 18 of the refrigerator 10. A reservoir of water may be provided that is chilled (e.g., by cold ice melt from the ice storage bin 104) or heated (e.g., thermal influence from the warm air in the air return pathway 64) by control of the intelligent control 200. The temperature 236 of the water in the cooling or heating application 230 may be controlled by controlling the fluid flow 238 and/or air flow 234 from the thermal sink process 232 to the cooling or heating application 230. One or more flow controllers 208 under operable control of the intelligent control 200 may be operated to perform the cooling or heating application 230. For example, the thermal sink process 232 may be used to lower the temperature 236 of the fluid flow 238 from the cooling application 230 (e.g., fluid sink harvesting heat from a water reservoir using cold ice melt). Alternatively, the temperature 236 of the air flow 234 may be increased using the thermal sink process 232 for warming the ice storage bin 104 or a water reservoir providing heating at a heating application 230 (e.g., an air sink under thermal influence of warm air in the return air pathway 64 used to warm a water reservoir). Air flow 234 from the refrigerator compartment 14 may also be used to provide cooling or heating. The air flow 234 to the thermal sink process 232 may be used for the cooling application or the heating application 230. For example, the air return pathway 64 from the thermal sink process 232 increases the temperature 236 at the heating application 230. Alternatively, the air flow 234 to the thermal sink process 232 may also be used to decrease the temperature 236 at the cooling application process 230. Intelligent control 200 may also be configured to control the ice bin process 240. One or more flow controllers 208 under operable control of the intelligent control 200 may be used to control air flow 244 (e.g., the warm air in the air return pathway 64) and/or fluid flow 248 (e.g., the cold air from the cooling application 82) from the to the ice bin 240. The temperature 246 of the fluid flow 248 to the ice bin 240 (e.g., from the cooling application 82) or the temperature of air flow 244 from the refrigerator compartment 14 to the ice bin 240 may be controlled using one or more flow controllers 208. The thermal sink process 242 may be configured in the cooling application 82 to provide a fluid flow 248 to the ice bin 240 having a lower temperature 246 or a fluid flow 248 to the ice bin 240 having a warmer temperature 246. Air flow 244 to the thermal sink process 242 may also be used to cool or warm the ice bin process 240. Air flow 244 from the refrigerator compartment may be used to cool the ice bin 240 whereas air flow 244 from the thermal sink process 242 may be used to warm the ice bin 240. Thus, the temperature 246 of fluid flow 248 or air flow 244 may be controlled using the intelligent control 200 in operable communication with one or more flow controllers 208 for controlling the ice bin process 240. For example, the fluid flow 248 from the cooling application 82 to the ice bin 240 may be controlled using one or more flow controllers 208 under operation of the intelligent control 200 whereby the temperature 246 of the fluid flow 248 is used in a cooling ice bin process 240 or warming ice bin process 240. Thus, one or more methods for controlling the temperature of one or more applications, such as for example, an ice making process on a refrigerator compartment door, are provided.

The foregoing description has been presented for the purposes of illustration and description. It is not intended to be an exhaustive list or limit the invention to the precise forms disclosed. It is contemplated that other alternative processes and methods obvious to those skilled in the art are considered included in the invention. The description is merely examples of embodiments. For example, the exact location of a thermal sink, air or fluid supply and return pathways may be varied according to type of refrigerator used and desired performances for the refrigerator. In addition, the configuration for providing heating or cooling on a refrigerator compartment door using a thermal sink process may be varied according to the type of refrigerator and the location of the one or more pathways supporting operation of the methods. It is understood that any other modifications, substitutions, and/or additions may be made, which are within the intended spirit and scope of the disclosure. From the foregoing, it can be seen that the exemplary aspects of the disclosure accomplishes at least all of the intended objectives.

What is claimed is:

1. A refrigerator that has a fresh food compartment, a freezer compartment, and a door that provides access to the fresh food compartment, the refrigerator comprising:

an insulated compartment mounted remotely from the freezer compartment;

an icemaker housed within the insulated compartment, the icemaker having an ice mold;

a thermoelectric device in directly contacting the ice mold, said thermoelectric device having a thermal influence on the ice mold and air in the air pathway; and an air pathway connected between the fresh food compartment and the thermoelectric device to move cool air from the fresh food compartment across the warm side of the thermoelectric device;

wherein the air pathway comprises an air supply pathway in communication with the fresh food compartment and an ice storage bin.

2. The refrigerator of claim 1 wherein the thermoelectric device comprises a cold side in thermal contact with the ice mold and a warm side in communication with the air pathway.

3. The refrigerator of claim 1 wherein the air pathway comprises an air return pathway in communication with the thermoelectric device and:

a. a warming or cooling application on the door;

b. the fresh food compartment; and c. the freezer compartment.

4. The refrigerator of claim 1 wherein the thermoelectric device comprises a plurality of thermoelectric components.

5. The refrigerator of claim 1 wherein the insulated compartment is mounted on the door.

6. The refrigerator of claim 1 wherein the ice storage bin is in the insulated compartment and positioned to receive harvested ice from the ice mold.

7. The refrigerator of claim 6 further comprising a drain from the ice storage bin for draining melt water from harvested ice out of the ice storage bin.

8. The refrigerator of claim 7 further comprising a water drain tube leading to a cooling application on the door using cold melt water.

9. A refrigerator that has a fresh food compartment, a freezer compartment, and a door that provides access to the fresh food compartment, the refrigerator comprising:

an icemaker mounted on the fresh food compartment door;

an ice mold within the icemaker, the ice mold having a surface for transferring heat;

a thermoelectric device having a cold side in thermal contact with the ice mold surface and a warm side;

an air pathway connected between the fresh food compartment and the thermoelectric device for supplying cold air across the warm side of the thermoelectric device;

an insulated compartment mounted on the fresh food compartment door; and an ice storage bin in the insulated compartment positioned to receive harvested ice from the ice mold;

wherein the air pathway comprises an air supply conduit connecting the fresh food compartment and the ice storage bin for supplying cold air to the ice storage bin from the fresh food compartment.

10. The refrigerator of claim 9 wherein the thermoelectric device comprises an ice harvesting mode with the cold side of the thermoelectric device thermally switched to the warm side to supply warmth to the surface of the ice mold.

11. The refrigerator of claim 9 wherein the thermoelectric device comprises a plurality of thermoelectric components.

12. The refrigerator of claim 9 wherein the insulated compartment is mounted on the door.

13. The refrigerator of claim 9 further comprising a drain from the ice storage bin for draining melt water from harvested ice out of the ice storage bin.

* * * * *